US006311909B1

(12) United States Patent
Lin

(10) Patent No.: US 6,311,909 B1
(45) Date of Patent: Nov. 6, 2001

(54) SYRINGE NEEDLE SHREDDER

(76) Inventor: A-Fang Lin, No. 19 Ho Chiang Street, Kaohsiung City (TW)

( * ) Notice: Subject to any disclaimer, the term of this patent is extended or adjusted under 35 U.S.C. 154(b) by 0 days.

(21) Appl. No.: 09/419,723

(22) Filed: Oct. 15, 1999

(51) Int. Cl.[7] ..... B02C 19/12

(52) U.S. Cl. ..... 241/101.4; 241/224; 241/236; 241/606

(58) Field of Search ..... 241/99, 606, 236, 241/224, 225, 101.4

(56) References Cited

U.S. PATENT DOCUMENTS 5,813,324 * 9/1998 Lin ..... 241/606

* cited by examiner

*Primary Examiner*—Mark Rosenbaum
(74) *Attorney, Agent, or Firm*—Alan Kamrath; Rider, Bennett, Egan & Arundel, LLP

(57) ABSTRACT

A feeding device receives various kinds of syringe needles and feeds them one by one into a press roller unit of a syringe needle shredder which pulls the needles, rolls the needles flat and then sends them down into a chopping roller unit to chop the flat needles into very small bits. The feeding device has a straight hole and a conical hole for different needles such as super short ones or special shaped ones to be fed down the needles maybe elastically clamped to securely move down to the press roller unit.

20 Claims, 8 Drawing Sheets

SYRINGE NEEDLE SHREDDER

BACKGROUND OF THE INVENTION

This invention relates to a syringe needle shredder, particularly to one possible to be used for shredding various kinds of syringe needles and specifically whether the syringe needles are super short or of special shapes.

There is a known conventional syringe needle shredder disclosed in U.S. Pat. No. 5,813,324, wherein a press roller unit and a chopping roller unit are provided for continually chopping syringe needles. The needle portion of a syringe needle is caught between flattened by the press roller unit. A guide net member located between the press roller unit and the chopping roller unit guides and corrects the position of the flat needles. The flat needles are then moved down into the chopping roller unit which chops them into very small bits which fall into a collect case. The very small bits are to be further sterilized by means of high pressure or are sent to a waste treatment organization for further treatment to prevent them from spreading diseases.

Althrough the conventional syringe needle shredder disclosed in the case of U.S. Pat. No. 5,813,324 can shred ordinary syringe needles, such conventional syringe needle shredder cannot shred special kinds of syringe needles such as super short ones or butterfly ones.

SUMMARY OF THE INVENTION

This invention has been devised to offer a feeding member placed on a press roller unit of a syringe needle shredder and which receives almost any kind of syringe needles for feeding into the press roller unit and the chopping roller unit of a syringe needle shredder so as to be chopped into very small bits.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
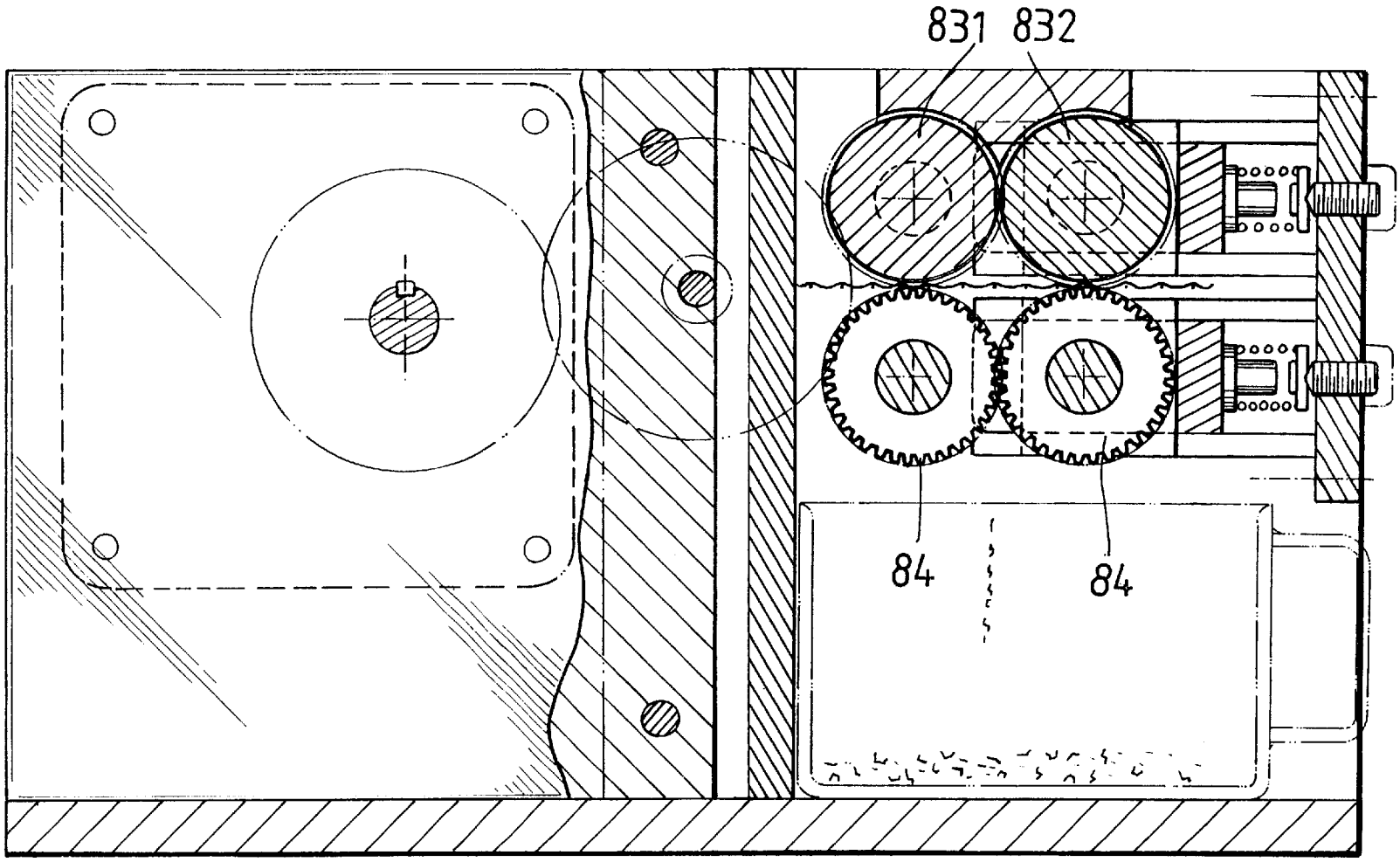
FIG. 1 is a front cross-sectional view of a syringe needle shredder in the present invention.
Figure 3:
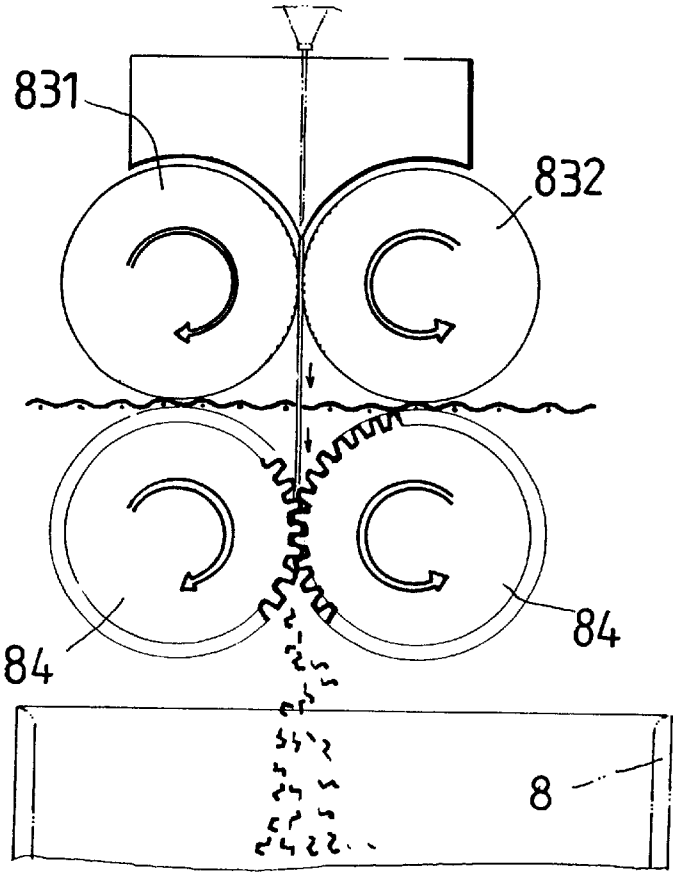
FIG. 3 is a view of chopping syringe needles by a chopping roller unit of the syringe needle shredder in the present invention.
Figure 2:
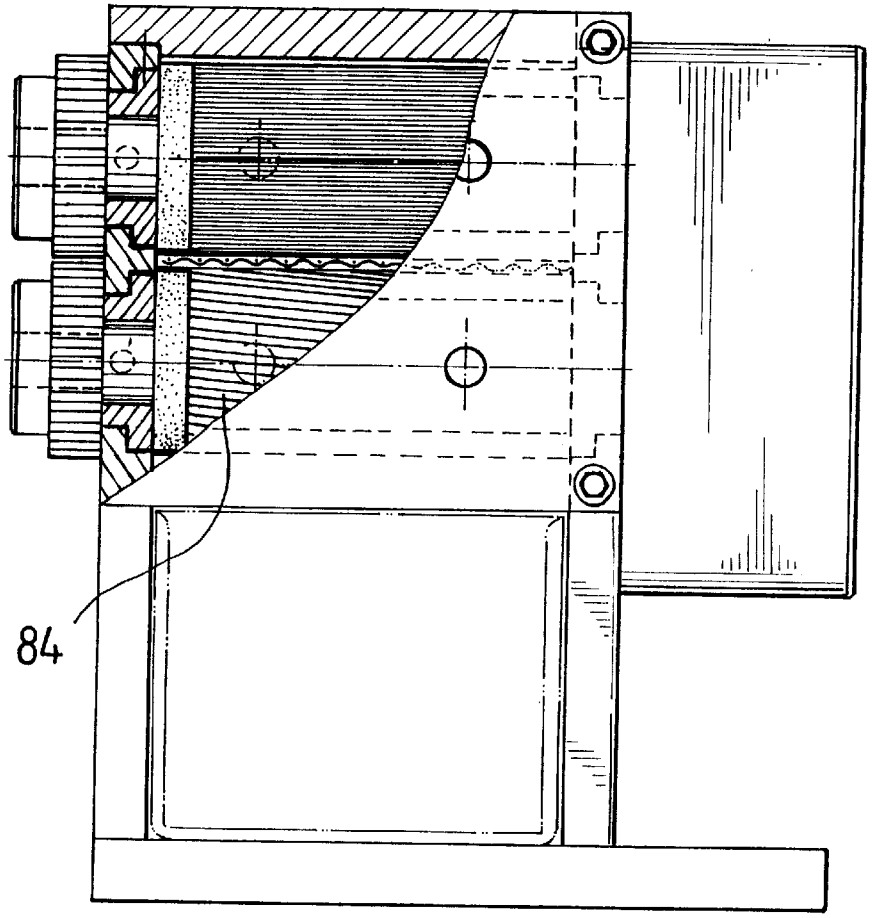
FIG. 2 is a side partial cross-sectional view of the syringe needle shredder in the present invention.
Figure 4:
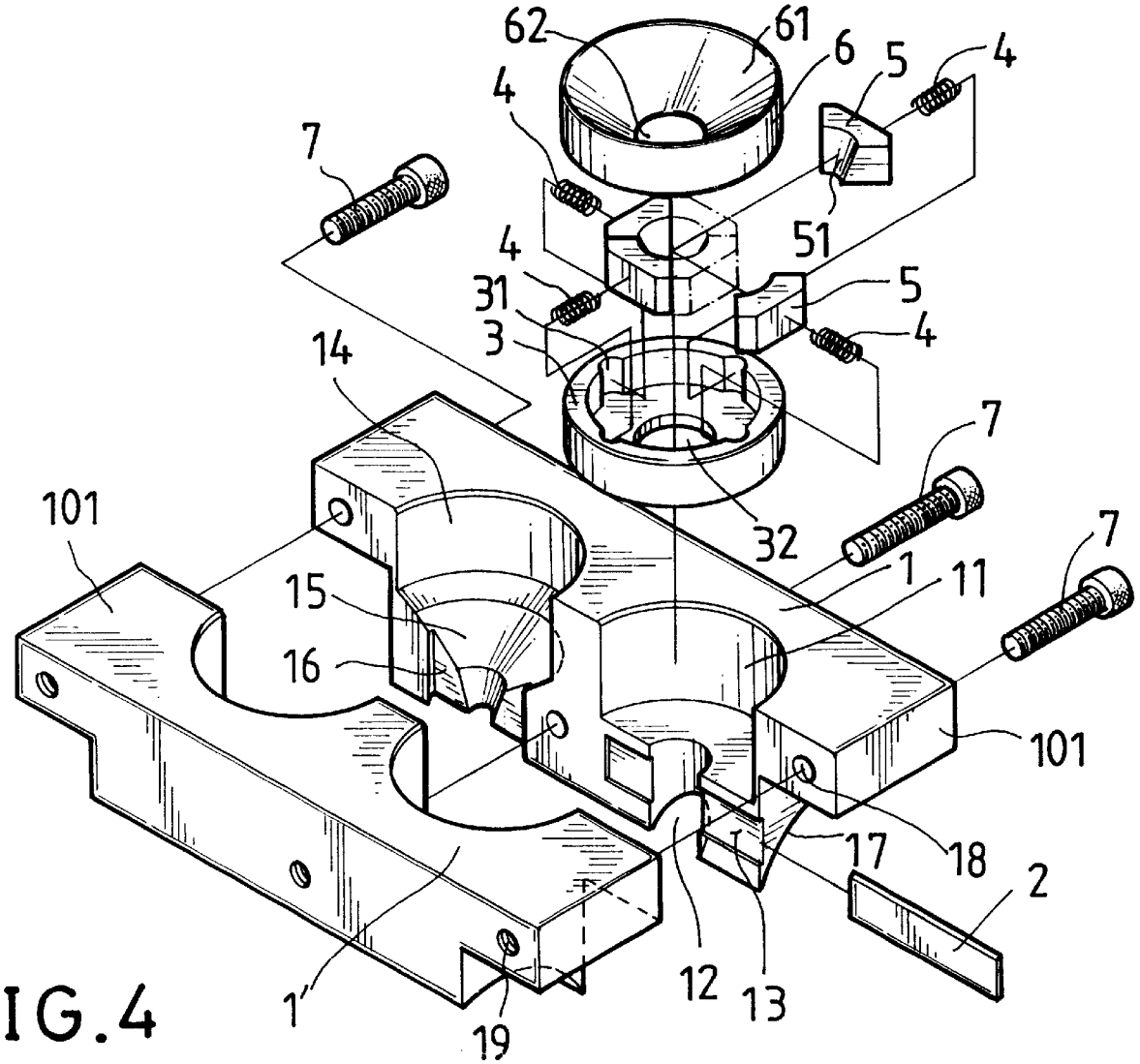
FIG. 4 is an exploded perspective view of a feeding member in the syringe needle shredder in the present invention.
Figure 5:
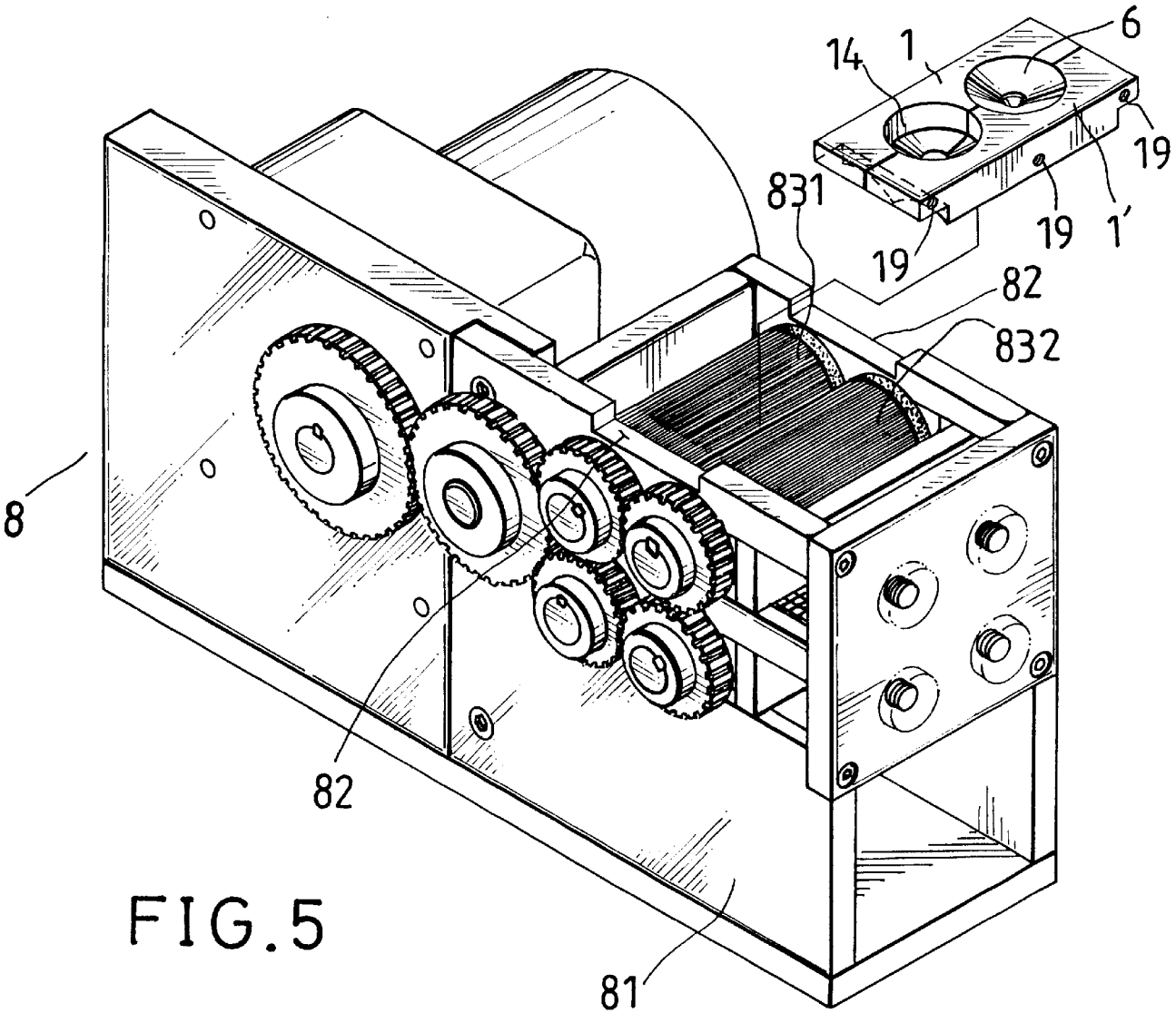
FIG. 5 is a perspective view of the feeding member being positioned in the syringe needle shredder in the present invention.
Figure 6:
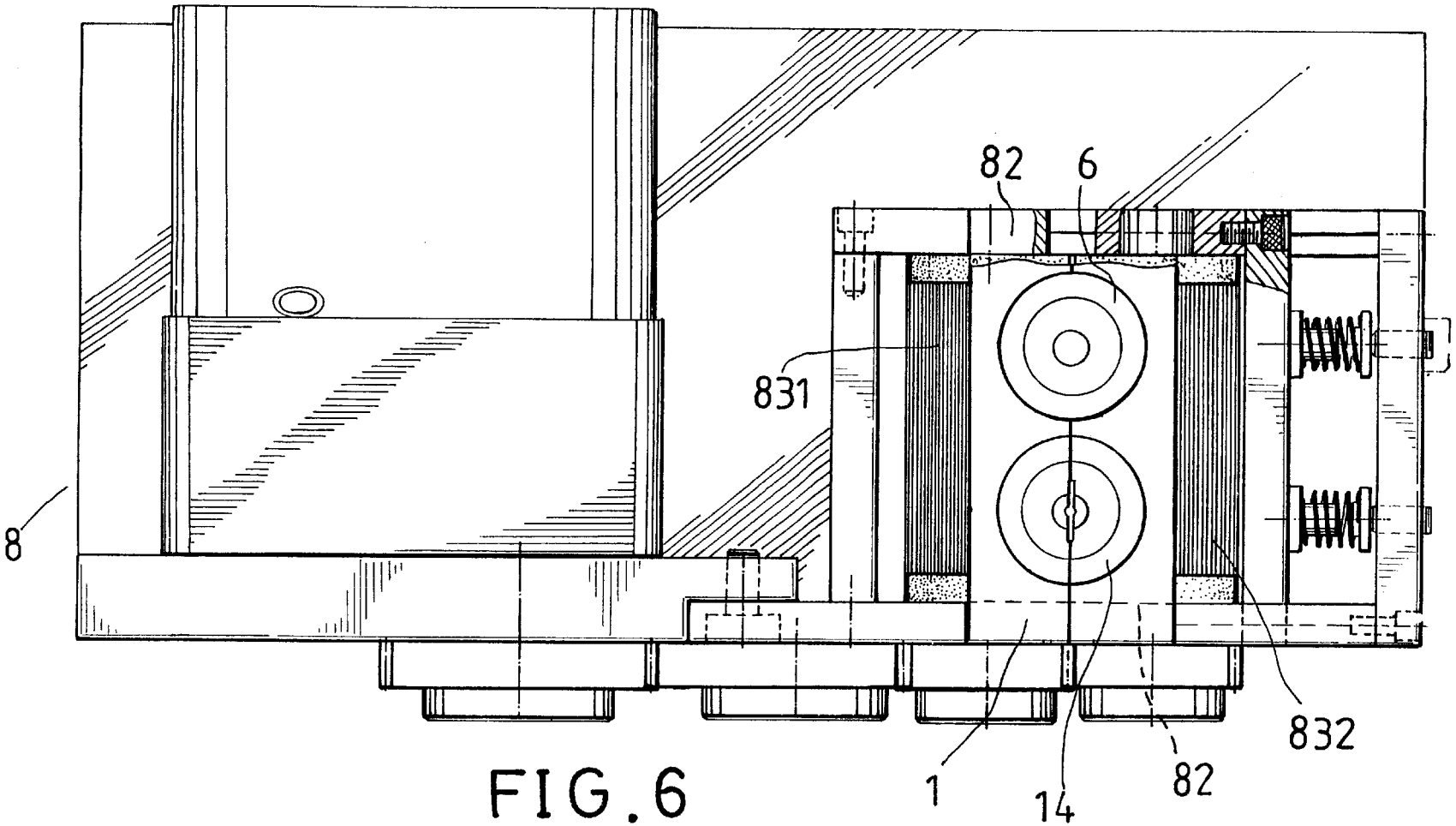
FIG. 6 is an upper view of the feeding member positioned in the syringe needle shredder in the present invention.

A preferred embodiment of a syringe needle shredder 8 in the present invention, as shown in FIGS. 4 and 5, mainly includes a feeding member, which includes a pair of position bases 1, 1', a lower annular member 3, a plurality of clamp blocks 5, and an upper annular member 6 as main components.

The pair of position bases 1, 1' have symmetrical shapes facing each other forming a first semicylindrical hole portion 11 and a second semicylindrical hole portion 14. The first semicylindrical hole portion 11 has a vertical circumferential wall and a small diameter hole portion 12 formed to extend down from the center of the bottom of the first hole defined by portions 11. A vertical recess 13 is formed in a wall beside the small hole 12 for a blade 2 to fit therein. The second semicircular hole portion 14 has a vertical circumferential wall and a semi-conical hole portion 15 of semi-circular cross-sections of several stages extending down from the vertical circumferential wall. Further, a recess 16 is formed in a side surface under the semi-conocal hole portion 15 in both of the position bases 1, 1'. The bottom surfaces 17 of both of the position bases 1, 1' have the shape corresponding to the upper surface of the position roller 831 of the press roller unit of the syringe needle shredder 8. The active roller 832, and the position base 1 has a plurality of lateral through holes 18, and the position base 1' has a plurality of lateral threaded holes 19 aligned to the through holes 18. The lower annular member 3 has a disc shape to fit in the first semi-cylindrical hole portions 11 of the pair of the position bases 1, 1'. A plurality of vertical slots 31 the formed in an inner wall of the lower annular member 3 and spaced apart equidistantly, with the ends of coil springs 4 resting in slots 31. A center hole 32 is formed in the bottom wall of the lower annular member 3 and aligned to the small hole 12.

A plurality of clamp blocks 5 are located in an upper interior of the lower annular member 3 and have a conical surface 51 formed in an inner side to closely fit around various kinds of syringe needles. A flat surface is formed in an outer surface of each clamp block 5 for contacting an end of the coil spring 4 located between each clamp block 5 and each vertical slot 31 so as to elastically push each clamp block 5 inward.

The upper annular member 6 is positioned on the lower annular member 3 and has a conical inner surface 61 center hole 62 is formed at the bottom of the conical surface 61 and has the same diameter as the upper end the inner conical surface 51 formed by the clamp blocks 5.

Figure 7:
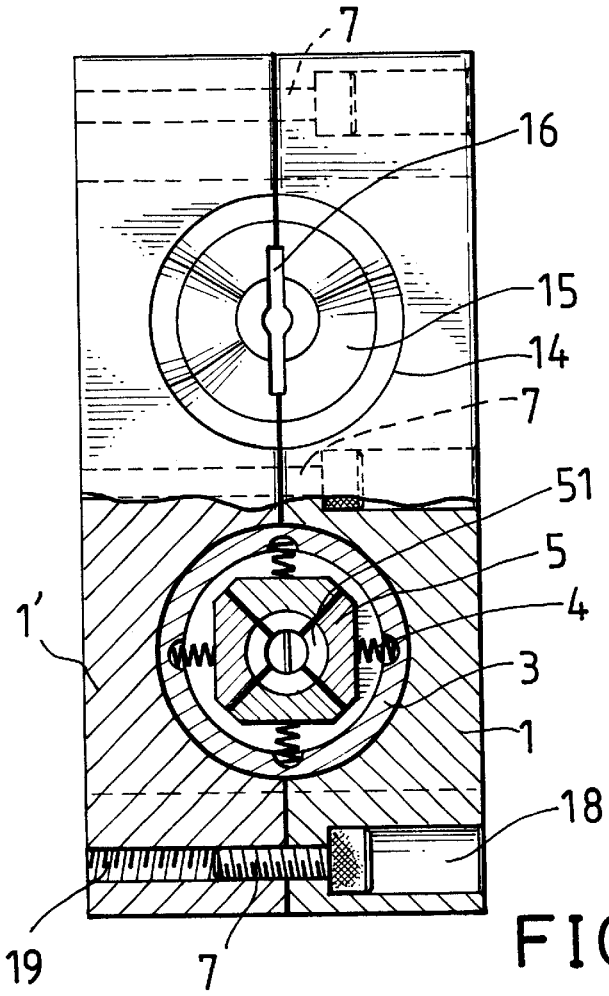
FIG. 7 is an upper cross-sectional view of the feeding member in the present invention.

In assembling the feeding member, as shown in FIG. 7, firstly, the pair of the position bases 1, 1' are put together for the bolts 7 to fit and screw in the through holes 18 and the threaded holes 19 to keep the pair of the position bases 1, 1' tightly together. Next, the lower annular member 3 together with the coil springs 4 and the clamp blocks 5 are placed in the first hole 11 of the position bases l, 1'. Then the upper annular member 6 is placed on the lower annular member 3. Thus, assembly of the feeding member is finished. After the feeding member is assembled, the position bases 1, 1' fitted together form a position base corresponding to and to be placed on the press roller unit including the position roller 831 and the active roller 832. Specifically, the whole feeding member is placed between the front and the rear walls 81 of the shredder 8, with the two side edges 101 of the front and the rear sides sitting on the recesses 82 of the front and the rear walls 81 of the syringe needle shredder 8 ready for chopping various kinds of used long and short syringe needles.

Figure 8:
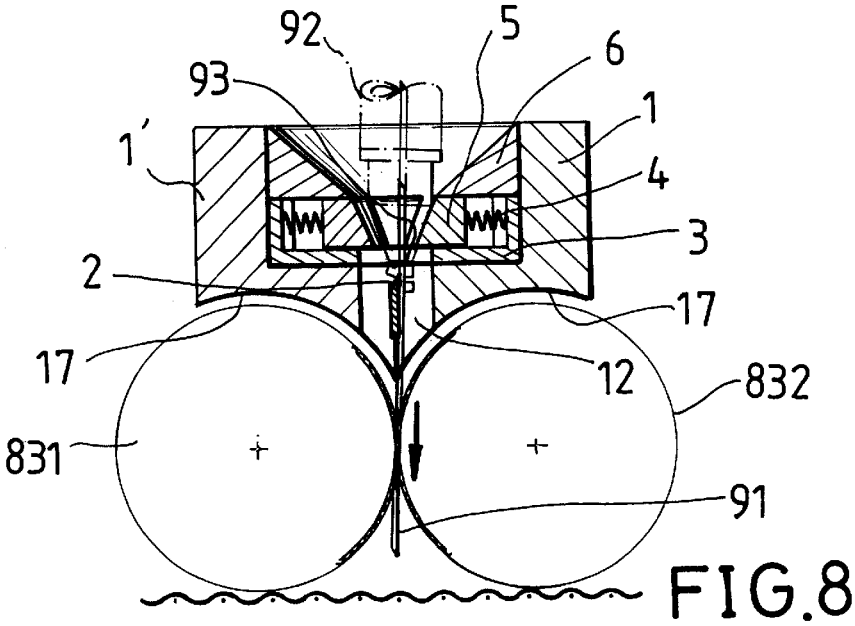
FIG. 8 is a cross-sectional view of a long syringe needle inserted in the feeding member in the present invention.
Figure 10:
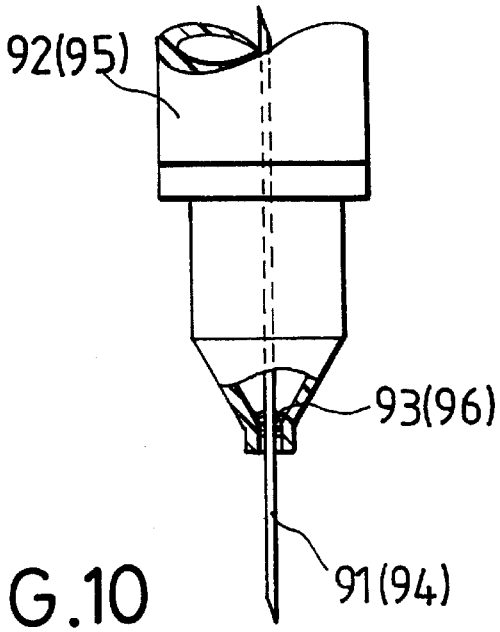
FIG. 10 is a crosssectional view of a standard syringe needle (a super short syringe needle); and, FIG. 11 is a magnified cross-sectional view of a blade in the feeding member cutting a syringe needle with a cap and a adhesive layer in the present invention.
Figure 9:
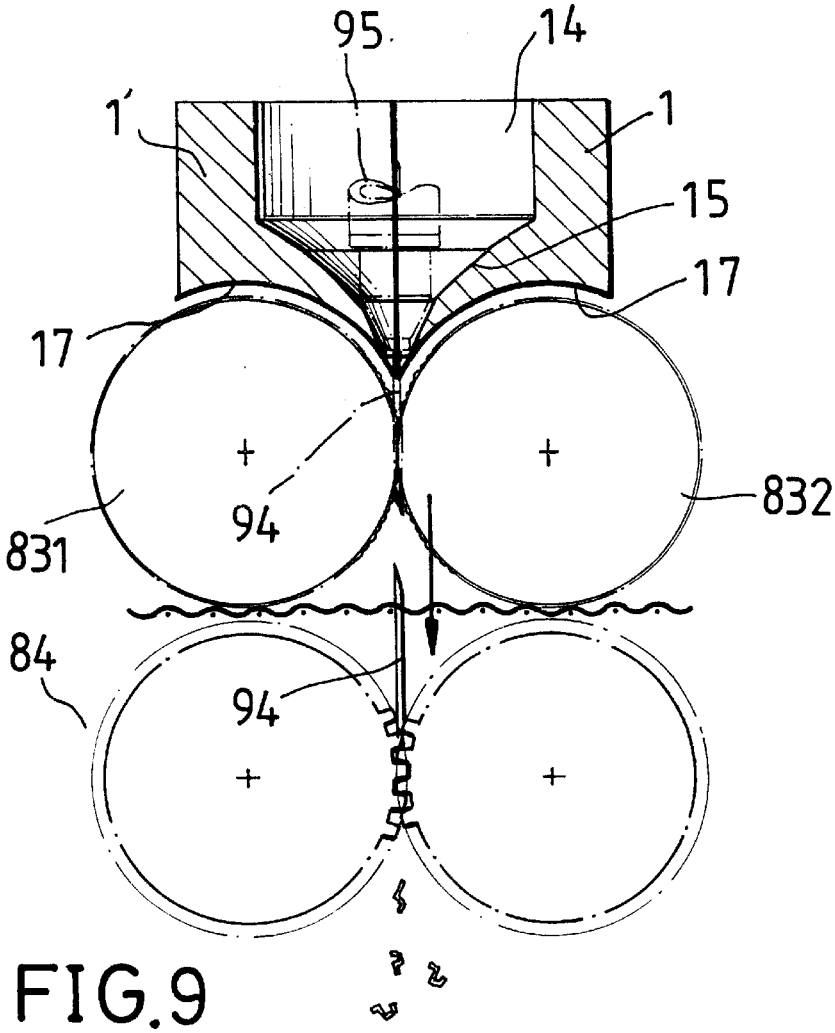
FIG. 9 is a cross-sectional view of a super short syringe needle inserted in the feeding member in the present invention.
Figure 11:
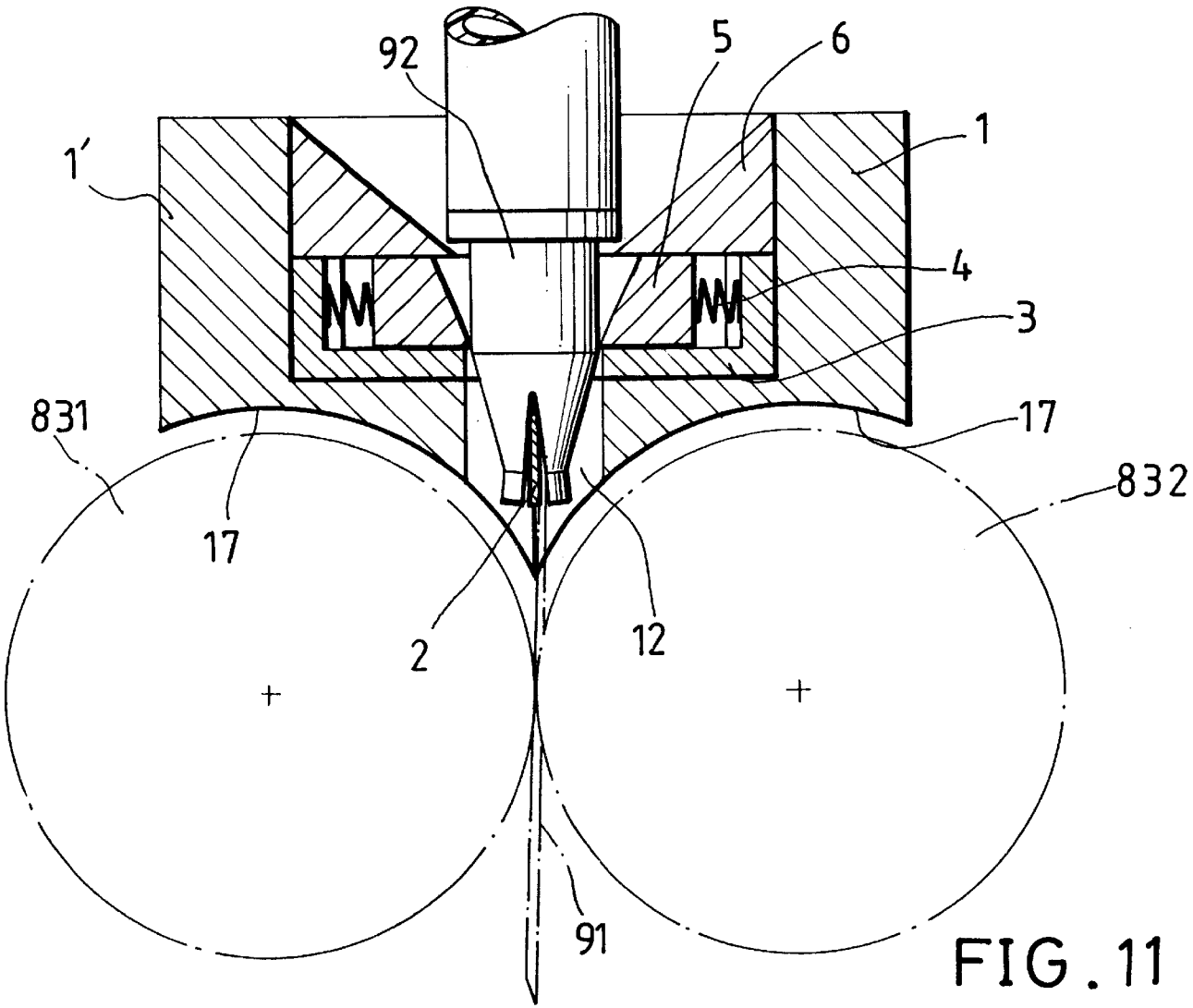

In shredding syringe needles 91 after use, as shown in FIGS. 8, 10, 11, an employee in a hospital holds the syringe needle 91 and inserts it into the center hole 62 of the upper annular member 6 until the needle 91 reaches the upper end of the press roller unit. Then, the needle 91 may be caught and moved forcibly down between the position roller 831 and the active roller 832 engagingly rolling. As the needle 91 is moving down just beside the blade 2 located parallel to the needle 91, a cap 92 of the needle 91 is cut open by the blade At the same time, the long adhesive layer 93 between the outer surface of the needle 91 and the cap 92 is broken. Thus, the needle 91 is separated from the cut cap 92 and moves down the press roller unit, which then presses the needle flat. The flat needle 91 is sent into the chopping roller unit 84 which then chops the flattened needle 91 into very small bits which fall down into a collect case. As Syringe needles which are super short having the length 10–12 mm or which have a special shape impossible to be inserted through the center hole 62 of the upper annular member 6 may be inserted into the second hole 14 of the position bases 1, 1', as shown in FIG. 9, specifically the hand of a worker holds the syringe to let the needle 94 move into the second hole portions 14 and pass through the conical surface portions 15 and into the press roller unit so as to be pulled down between the position roller 831 and the active roller 832. As for a butterfly needle, so called mundanely, having two wOings in a wide cap 95, may be pushed through the recess 16 beside the conical surface portions 15, permitting the needle 94 to be pulled down by the press roller unit, with the adhesive layer 96 also being pulled down. The needle 94 is thus pressed flat and is gradually sent into the chopping roller unit 84 to be chopped into very small bits and collected in a collect case located below the chopping roller unit 84.

While the preferred embodiment of the invention has been described above, it will be recognized and understood that various modifications may be made therein, and the appended claims are intended to cover all such modifications which may fall within the spirit and scope of the invention.

What is claimed is:

1. Member for shredding a syringe needle comprising; in combination: a syringe needle shredder including a press roller unit having an upper end; a position base adapted to be supported relative to the syringe needle shredder, with the position base including a bottom surface adapted to correspond to the upper end of the press roller unit and including an upper surface; a first hole formed in the position base and having a vertical circumferential wall extending down from the upper surface towards but spaced from the bottom surface and having a center; and a second hole formed in the position base and extending down from the center of the first hole and to the bottom surface, with the second hole having a smaller diameter than the first hole, with used syringe needles being pushed one by one into and through the first hole and then into and through the second hole to be caught and moved forcibly down by the press roller unit of the syringe needle shredder.

2. Member for feeding a syringe needle into a syringe needle shredder including a press roller unit having an upper end, comprising, in combination: a position base adapted to be supported relative to the syringe needle shredder, with the position base including a bottom surface adapted to correspond to the upper end of the press roller unit and including an upper surface; a first hole formed in the position base and having a vertical circumferential wall extending down from the upper surface towards but spaced from the bottom surface and having a center; a second hole formed in the position base and extending down from the center of the first hole and to the bottom surface, with the second hole having a smaller diameter than the first hole, with used syringe needles being pushed one by one into and through the first hole and then into and through the second hole to be caught and moved forcibly down by the press roller unit of the syringe needle shredder; and first and second vertical gaps formed in the position base and extending radially on opposite sides of the second hole for receiving syringe needles having special shapes including wings.

3. The feeding member as claimed in claim 2 wherein the base is formed by a pair of components, with the first and second holes and the first and second vertical gaps being formed by symmetrical shapes in the pair of components which face each other.

4. The feeding member as claimed in claim 2 wherein the second hole is a conical hole.

5. The feeding member as claimed in claim 4 wherein the conical hole includes several stages.

6. Member for feeding a syringe needle into a syringe needle shredder including a press roller unit having an upper end, comprising, in combination: a position base adapted to be supported relative to the syringe needle shredder, with the position base including a bottom surface adapted to correspond to the upper end of the press roller unit and including an upper surface; a first hole formed in the position base and having a vertical circumferential wall extending down from the upper surface towards but spaced from the bottom surface and having a center; a second hole formed in the position base and extending down from the center of the first hole and to the bottom surface, with the second hole having a smaller diameter than the first hole, with used syringe needles being pushed one by one into and through the first hole and then into and through the second hole to be caught and moved forcibly down by the press roller unit of the syringe needle shredder; and a blade extending through the second hole.

7. The feeding member as claimed in claim 6 further comprising, in combination: a recess formed in the position base beside the second hole for the blade to fit in; and wherein the base is formed by a pair of components, with the first and second holes and the recess being formed by symmetrical shapes in the pair of components which face each other.

8. Member for feeding a syringe needle into a syringe needle shredder including a press roller unit having an upper end, comprising, in combination: a position base adapted to be supported relative to the syringe needle shredder, with the position base including a bottom surface adapted to correspond to the upper end of the press roller unit and including an upper surface; a first hole formed in the position base and having a vertical circumferential wall extending down from the upper surface towards but spaced from the bottom surface and having a center; a second hole formed in the position base and extending down from the center of the first hole and to the bottom surface, with the second hole having a smaller diameter than the first hole, with used syringe needles being pushed one by one into and through the first hole and then into and through the second hole to be caught and moved forcibly down by the press roller unit of the syringe needle shredder; and a plurality of clamp blocks located in the first hole, with the plurality of clamp blocks being elastically pushed inward toward the center of the first hole; and a third hole formed by each of the clamp blocks when elastically pushed inward for syringe needles to move therein.

9. The feeding member as claimed in claim 8 wherein the third hole is in the form of a conical surface.

10. The feeding member as claimed in claim 8 further comprising, in combination: an upper annular member having a shape to fit in the first hole, with the clamp blocks being captured in the first hole by the upper annular member, with the upper annular member having a fourth hole aligned with the third hole.

11. The feeding member as claimed in claim 10 wherein the fourth hole is a conical surface.

12. The feeding member as claimed in claim 10 further comprising, in combination: a lower annular member having a shape to fit in the first hole, with the lower annular member having a hollow interior in which the plurality of clamp blocks are placed, with the upper annular member being positioned on the lower annular member.

13. The feeding member as claimed in claim 12 wherein the lower annular member has a fifth hole aligned with the second hole and the third hole.

14. The feeding member as claimed in claim 12 wherein the clamp blocks are elastically pushed inward by a plurality of coil springs located between the clamp blocks and the lower annular member.

15. The feeding member as claimed in claim 14 wherein the hollow interior of the lower annular member is defined by a wall having a plurality of vertical grooves; and wherein each of the clamp blocks includes a flat surface opposite to the third hole, with each of the coil springs including a first end located in one of the vertical grooves and a second end against the flat surface of the clamp block.

16. The feeding member as claimed in claim 8 further comprising, in combination: a blade extending through the second hole.

17. The feeding member as claimed in claim 8 further comprising, in combination: a fourth hole formed in the position base and having a vertical circumferential wall extending down from the upper surface towards but spaced from the bottom surface and having a center; and a fifth hole formed in the position base and extending down from the center of the fourth hole and to the bottom surface, with the fifth hole having a smaller diameter than the fourth hole, with used syringe needles being pushed one by one into and through the fourth hole and then into and through the fifth hole to be caught and moved forcibly down by the press roller unit of the syringe needle shredder.

18. The feeding member as claimed in claim 17 wherein the base is formed by a pair of components, with the first, second, fourth, and fifth holes being formed by symmetrical shapes in the pair of components which face each other.

19. The feeding member as claimed in claim 17 further comprising, in combination: first and fifth vertical gaps extending radially on opposite sides of the fifth hole for receiving syringe needles having special shapes including wings.

20. The feeding member as claimed in claim 17 wherein the fifth hole is a conical hole.

* * * * *